United States Patent [19]

Bubley

[11] 4,413,559

[45] Nov. 8, 1983

[54] MULTI-SPEED DRIVE FOR SCREEN PRINTING PRESSES

[75] Inventor: Henry J. Bubley, Deerfield, Ill.

[73] Assignee: American Screen Printing Equipment Company, Chicago, Ill.

[21] Appl. No.: 403,856

[22] Filed: Jul. 30, 1982

Related U.S. Application Data

[63] Continuation of Ser. No. 850,256, Nov. 11, 1977, abandoned.

[51] Int. Cl.[3] ..... B41F 15/14; B41F 15/44

[52] U.S. Cl. ..... 101/123

[58] Field of Search ..... 101/123, 124, 126, 129, 101/114

[56] References Cited

U.S. PATENT DOCUMENTS

| | | | |
|---|---|---|---|
| 3,811,669 | 5/1974 | Benson et al. | 270/31 |
| 4,079,674 | 3/1978 | Ichinose | 101/123 X |
| 4,090,443 | 5/1978 | Gasser | 101/123 |
| 4,111,118 | 9/1978 | Green et al. | 101/123 |
| 4,184,427 | 1/1980 | Bubley et al. | 101/123 |

*Primary Examiner*—Clifford D. Crowder

*Attorney, Agent, or Firm*—Fitch, Even, Tabin & Flannery

[57] ABSTRACT

A screen printing press including structure and electrical control circuits which permit selection of optimum speeds for the flood and print strokes, and which speeds may differ one from the other.

9 Claims, 7 Drawing Figures

MULTI-SPEED DRIVE FOR SCREEN PRINTING PRESSES

This is a continuation of application Ser. No. 850,256, filed Nov. 11, 1977, now abandoned.

BACKGROUND OF THE INVENTION

This invention relates to multi-speed drives for screen printing presses.

In screen printing, as is known, an ink is transferred to the printing surface by means of a transfer member or squeegee through a stencil screen. The basic operation requires a flood stroke followed by a print stroke. In the flood mode, when the flood stroke is made, a flood bar is caused to move across the screen to flood the screen with ink, and in the print mode, when the print stroke is made, a squeegee then moves across the screen to push the ink through the screen onto the object being printed.

Uniform ink distribution during the flood mode is not only highly desirable, but essential to obtaning high-quality prints. In order to obtain such uniform ink distribution, it has been found that the operating speed at which the flood bar is caused to move across the screen during the flood mode should be somewhat slower than the operating speed at which the squeegee moves across the screen during the print mode. Further, the inks utilized on the screen may vary in viscosity and consistency depending on job requirements, atmospheric conditions and other factors; and therefore, the speed at which the flood bar should move across the screen to optimally flood the screen can vary from ink to ink and object to object.

Generally, in the prior art, the print and flood strokes were coordinated to operate at the same speed, that of the flood stroke, which normally was the lower of the two speeds. Thus, the output of the press was limited to the speed at which the screen could be flooded, even though a higher printing speed, if possible, would be desirable. Attempts to achieve this separate speed ability in the flood mode and the print mode utilized separate sources of power to drive the squeegee and the flood bar during their respective strokes.

Note that silk screen printing processes involve various types of relative displacements between the surface to be printed, the screen, and the squeegee dependent on the printing surface. In the case of a flat continuous printing surface, such as paper stock, the screen and the printing surface may be held relatively stationary with respect to each other and the squeegee and the flood bar moved across the screen. In the case of printing surfaces which are not flat, the screen may be held stationary and the work surface subjected to rotational movement; or, the screen may be moved in synchronism with the curved surface. Thus, it is a purpose and object of the present invention to provide means which are universal for adjusting and controlling the operating speed of movement of the squeegee across the associated screen; and for adjusting and controlling the speed of movement of the flood bar at a second speed, independently of the squeegee and regardless of the shape of the object to be printed upon.

An advantage of the invention is that the operator can adjust either the printing or flooding speed independently to suit the characteristics of the ink being used. This is particularly useful in printing a heavy bodied or viscous ink which requires a slower than normal flood speed but a relatively normal print speed. An example of a somewhat different requirement, that also benefits from independent adjustment of the speed of the flood and print strokes, arises when printing with vinyl inks since vinyl inks require a particularly fast print stroke for good definition, but a much slower flood stroke.

SUMMARY OF THE INVENTION

The present invention relates to a screen printing machine or press incorporating a novel drive structure and electrical circuit for setting and controlling the speed for the flood stroke, and for setting and controlling the print stroke independently of the flood stroke. Adjustable electrical switching means are provided to enable the operator to choose the most desirable speed for each operating mode to obtain a maximum output with the highest quality of print. The invention provides a dual current control circuit for a drive motor with each circuit controlling a respective one of the operating modes.

In one embodiment each current control circuit includes potentiometers which controllably limit the amplitude of the current coupled to a D.C. motor. The timing to selectively connect each potentiometer into operation is determined through a cam located on the press drive that activates a suitable limit switch. The limit switch is connected so that the normally open terminal controls one mode, and a normally closed terminal controls the other mode. The cam and limit switch thus identify the mode of operation and connect the appropriate potentiometer into the electrical drive circuit to control the speed of the motor during that mode of operation.

Accordingly, it is an object of this invention to provide a new and improved drive and electrical control circuits for a screen printing press, which drive will permit adjustable and independent selection of different speeds for the flood and print strokes.

It is a further object of this invention to provide a new and improved screen printing press having a single drive motor and including structure and electrical control circuits which permit selection of optimum speeds for the flood and print strokes which speeds may differ one from the other.

Further objects, advantages and features of this invention will become apparent by reference to the accompanying drawings and following specification, in which:

BACKGROUND OF THE INVENTION

Figure 1:
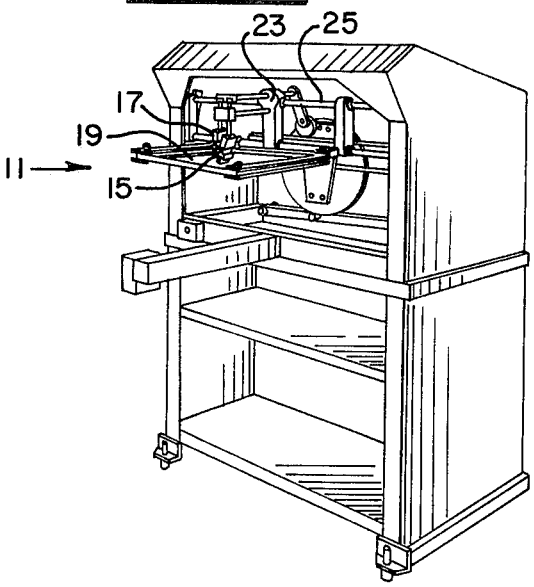
FIG. 1 is a perspective view of one form of a screen printing press utilizing this invention.

FIG. 1 shows a screen printing press or machine 11 incorporating the present invention. The printing press 11 may be of the type disclosed and claimed in U.S. Patent Application, Ser. No. 720,763, now U.S. Pat. NO. 4,111,118 in the name of Melvin E. Green, et al., filed Sept. 7, 1976, entitled "Multi-Purpose Screen Printing Machine", and in U.S. Patent Application Ser. No. 827,738, now U.S. Pat. No. 4,184,427 which is a continuation-in-part of the above named U.S. application Ser. No. 720,763. The structure of the screen printing press 11 is disclosed and described in full detail in the aforesaid U.S. Pat. No. 4,111,118, and U.S. Pat. No. 4,184,427, and the description therein is included herein by reference. Only that portion of the machine description which is necessary to the understanding of the control mechanism and circuitry of the present invention will be repeated in this application.

Figure 2:
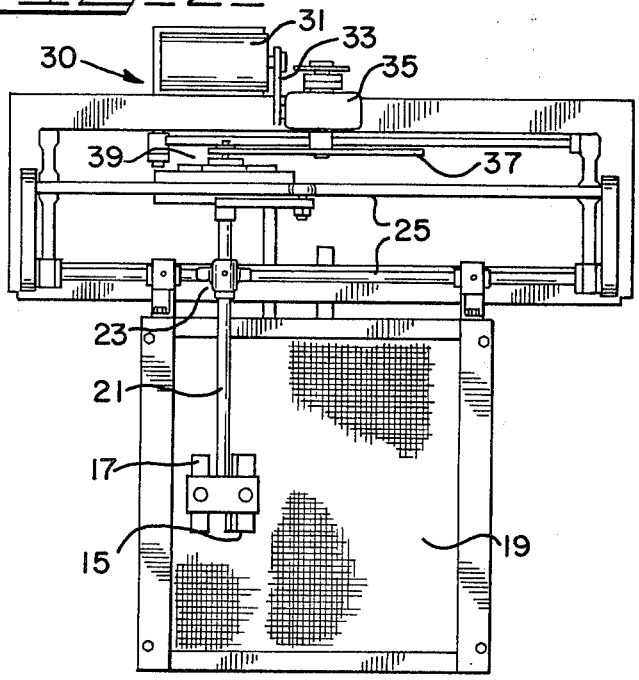
FIG. 2 is a relatively enlarged plan view of a portion of the press of FIG. 1 to show the relation of the flood bar, the squeegee and the screen.

Referring now also to FIG. 2 of the drawings, the present invention relates particularly to the structure and circuitry for controlling the relative speed of travel or movement of the squeegee 15, and the flood bar 17 across the surface of the screen 19.

As discussed in the U.S. Pat. No. 4,111,118 and U.S. Pat. No. 4,184,427, the printing press 11 includes a supporting frame and an associated drive linkage mechanism for supporting the squeegee 15, the flood bar 17 and the screen 19 in proper operative relationship and for permitting desired relative movement to be imparted to the squeegee 15, the flood bar 17, and the screen 19 with respect to one another and to the printing surface (not shown). The squeegee 15 and flood bar 17 are mounted on the same mounting assembly arm 21 which assembly is in turn positioned on a carriage 23 mounted for movement on a frame 25. As discussed in the aforesaid application, in the flood mode of operation for flat objects such as sheet stock, the flood bar 17 is lowered to be in an operative position adjacent the screen 19 during the flood stroke, as it moves in a first direction, across the screen. In the subsequent or print mode of operation, the squeegee 15 is lowered to be in an operative position adjacent the screen 19 during the print stroke, as it moves in a second or reverse direction, across the screen.

The relatively enlarged plan view of FIG. 2 also clearly shows the driving mechanism, generally labeled 30, which drives the squeegee 15 and drive bar 17 over the surface of the screen. The driving mechanism 30 includes a motor 31, of any suitable known design; and, which in one embodiment is a D.C. permanent magnet motor. A drive belt 33 connects the motor 31 to a gear box 35, also of any suitable known design. The gear box 35 in turn connects to a swiss cam 37 and a drive linkage 39. The operation of swiss cam 37 and linkage 39, is fully described in the aforesaid patent application Ser. No. 720,763. Briefly, the swiss cam 37 and linkage 39 are arranged to drive or move the carriage 23 in a reciprocal motion to thereby move the assembly arm 21, on which squeegee 15 and flood bar 17 are mounted, in a horizontal and reciprocal motion adjacent screen 19. As mentioned above, and as can be seen in the isometric view of FIG. 1, the squeegee 15 and flood bar 17 may be mounted adjacent each other on the end of the assembly arm 21. The drive mechanism 30 synchronizes the movement of the carriage 23 and the pivoting operation of the squeegee and flood bar 17.

In one embodiment and as described in said Ser. No. 827,738, the squeegee 15 and flood bar 17 are fixedly mounted on assembly arm 21 for lateral movement across screen 19. In another embodiment, and as described in Ser. No. 720,763, the squeegee 15 and flood bar 17 are mounted in vertically pivoting relation. In this latter embodiment, the squeegee 15 is moved downwardly for the print stroke and concurrently the flood bar 17 is moved upwardly to a non-operating position. For the flood stroke, the flood bar 17 is moved downwardly to an operating position and the squeegee is moved upwardly to a non-operating position. The inventive structure and control circuitry function equally well and are applicable and equally useful for both embodiments of the squeegee and flood bar mounting.

Figure 4:
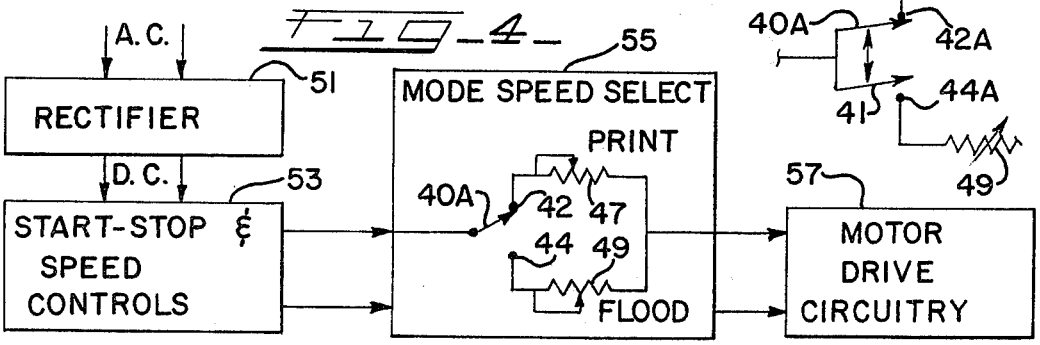
FIG. 4 is an electrical control circuitry of the invention in block form and showing the circuit details of the mode speed select feature of the invention.

FIG. 4 shows the electrical control circuitry or system of the invention in block diagram form. Current from a suitable alternating current (A.C.) source is rectified in a rectifier circuit 51 of any suitable known design. The direct current (D.C.) output from the rectifier 51 is connected to a start-stop and speed select control circuitry 53, of any suitable known design. The output of the start-stop speed controls 53 are connected to a mode speed select circuit 55 provided in accordance with the present invention, and which will be discussed in more detail hereinbelow. The output of the mode speed select circuit 55 is connected to the motor drive circuitry 57 which drives motor 31 (see FIG. 2) also of any suitable known design.

In one embodiment, the mode speed select circuit 55 includes parallel connected potentiometers (pots) 47 and 49 which have their input end connected to separate stationary contacts or terminals 42 and 44, respectively and which comprise a part of a single throw switch 40. The movable contact 40A of the switch 40 is arranged to make selective electrical contact with one or the other of stationary contacts 42 and 44. The second or output ends of potentiometers 47 and 49 are connected in common with one another, and to the motor drive circuitry 57.

As will be appreciated when the movable contact 40A contacts stationary contact 42, the drive current to the motor drive circuitry 57 is conducted through pot 47. Similarly, when contact 40A contacts stationary contact 44, the drive current to the motor drive circuitry 57 is conducted through pot 49. Thus, the pots 47 and 49 selectively control the amplitude of the drive current to the motor, and accordingly, control the operating speed of the motor 31.

Thus, pots 47 and 49 are independently adjustable to insert a selected amount of resistance into the motor drive circuit 57 to selectively control the speed at which the motor 31 drives the assembly 21 and hence the squeegee 15 and flood bar 17 during the print and flood modes, respectively.

Figure 5:
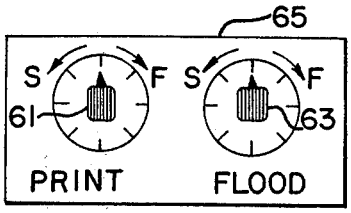
FIG. 5 is a showing of a front panel control for the mode select feature of FIG. 4.

FIG. 5 shows two manually positionable knobs 61 and 63 mounted in an easily accessible control panel 65, of any suitable design, for adjusting the position of the variable contact arm or wiper of each of potentiometers 47 and 49. The setting for the knobs 61 and 63 may be calibrated as indicated in the drawing to select a slow (S) or faster (F) speed; or, the setting may be calibrated with any other useful scale.

Figure 3:
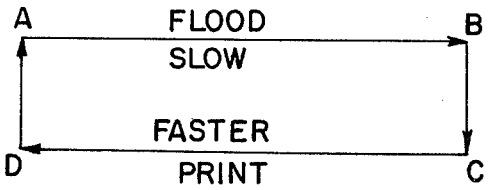
FIG. 3 is a motion diagram useful in explaining the concept of the invention.

Refer now to FIG. 3, which shows a sketch which is essentially a motion diagram of the print and flood operational modes of the screen printing press. As discussed above, the mounting assembly 21 which carries the squeegee 15 and flood bar 17 moves in a reciprocating motion across screen 19 and it is desired that the movement of the assembly 21 in the flood mode be slow in a first direction, as indicated by arrow A to B of FIG. 3. In the print mode, it is desired that the assembly arm 21 move relatively faster in the opposite or reverse direction as indicated in arrow C to D in FIG. 3. Obviously, as the assembly arm 21 reaches the end of travel position, it momentarily stops, and must be almost instantaneously accelerated to the speed desired. Thus, it is at points B and D that the movable contact 40A switches from contacts 44 to 42 (FIG. 4) to change the drive current supplied to the motor circuitry 57.

Figure 6:
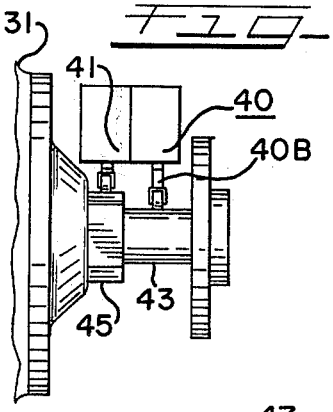
FIG. 6 is a relatively enlarged view of a portion of FIG. 2 to show cam and limit switch structure; and, FIG. 7 shows a modification of the switching circuitry of FIG. 4.

FIG. 6 is a side view of the portion of the motor 31 including a suitable cam operated switch 40, which includes a plunger or rod 40B biased to ride on the respective cam shaft 43. As is known in the art, dependent on the position of the cam shaft 43, switch 40 selectively provides switching from the electrical circuitry of FIG. 4. Switch 40 is adjusted and positioned relative to the respective cam, to close and open in synchronization with the movement of the squeegee 15 and flood bar 17. More specifically, at the point or position when the assembly arm 21 moves to a maximum, or end of travel position, at one side of the screen 19 and which is the completion of the print mode, the plunger 40B of switch 40 is caused to move to a downwardly extended position which opens or disconnects the movable electrical contact 40A of FIG. 4 from stationary contact 42. In turn, movable contact 40A is biased to close against stationary contact 44 of FIG. 4, to thereby connect the current, that is, complete the current path to motor 31 through potentiometer (pot) 49. In this mode of operation, the amplitude of the drive current to motor 31 is dependent on the setting of pot 49, and accordingly, the speed of the motor will be controlled by the setting of pot 49. Further, the speed of travel or movement of the entire driving mechanism 30 and therefore the speed of travel or movement of mounting assembly arm 21 and of the flood bar 17 in its operating mode will be controlled by the setting of pot 49.

Likewise, when the mounting assembly 21 moves to the opposite direction on the screen 19, switch 40 closes its movable contact 40A against stationary contact 42. In this position, the drive current is connected through pot 47 to drive the motor 31. The speed of the motor 31 will thus be dependent on and controlled by the setting of potentiometer 47 to thereby control the speed of movement of the assembly arm 21 and of the squeegee 15 in the squeegee operating mode.

Figure 7:
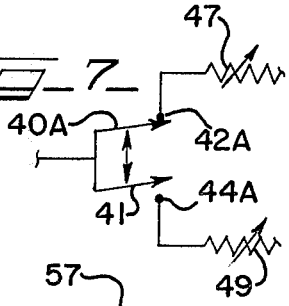

For certain applications, a double throw single pole switch as shown in FIG. 7 may be provided instead of the single pole switch of FIG. 4. In such cases, an additional cam operated switch 41, similar to switch 40, can be positioned to ride on a cam shaft 45 to actuate its movable contact arm 41 relative to an associated stationary contact 44A connected to pot 49. The double pole single throw switch 41 of FIG. 7 provides a convenient means of making necessary mechanical adjustments for timing and synchronizing purposes, and can also be adjusted to provide a make-before-break electrical connection to insure smooth circuit operation.

It should of course be appreciated that the suitable current amplitude control devices, such as current limiting amplifiers could be employed instead of potentiometers 47 and 49. However, potentiometers are utilized in the embodiment described since they are easily adjusted, rugged, stable, and relatively inexpensive, and provide a sufficiently accurate control of the current to the motor.

In summary, the present invention thus provides a screen printing press including structure and circuitry for adjusting and controlling the speed of the printing stroke independently of the speed of the flooding stroke to thereby permit the screen printing press to operate at an optimum speed, as well as at an optimum flood bar speed.

While the invention has been particularly shown and described with reference to preferred embodiments thereof, it will be understood by those skilled in the art that various changes in the form and details may be made therein without departing from the spirit and scope of the invention.

I claim:

1. A screen printing press including a screen, an assembly arm positioned for reciprocating lateral movement above said screen during a print mode and a flood mode, a squeegee and a flood bar mounted adjacent one another on said assembly arm, said flood bar being functionally operative to provide a flood stroke during the flood mode as it is moved by said assembly arm in a lateral first direction across said screen and being functionally inoperative as it is moved in the opposite lateral direction across said screen, said squeegee being functionally operative to provide a print stroke during the print mode as it is moved in the opposite direction and being functionally inoperative as it is moved in the first direction, an electrically powered drive means including a direct current motor for driving said assembly arm, and said squeegee and flood bar, cam means driven by said electrically powered drive means having characteristics associated with the flood stroke and printing stroke, limit switch means operable by said cam means with movement of said assembly arm at the end of its travel in each of the first and opposite directions to cause a change in motor speed, first electrical current control means selectively associated with said limit switch means and said direct current motor for controlling the speed of said drive means during the flood stroke, and ssecond electrical current control means selectively associated with said limit switch means and said direct current motor for controlling the speed of said drive means during the print stroke independently of the control provided by said first electrical current control means.

2. An apparatus as in claim 1 wherein each of said electrical current control means is selectively adjustable to vary the speed of the motor, dependent on the desired printing operation.

3. An apparatus as in claim 1 wherein said limit switch means includes a cam operated switch having first and second switch contacts, each connected to one of the respective first and second electrical current control means.

4. An apparatus as in claim 3 in which said electrically powered drive means includes a shaft, said cam means being mounted on the shaft to turn therewith, and a limit switch plunger on said limit switch means rides on the cam means, said limit switch plunger opening and closing the respective first and second switch contacts.

5. An apparatus as in claim 3 in which said first and second electrical control means comprise first and second variable resistance means connected in parallel and being selectively adjustable to control the current flow therethrough, said first and second variable resistance means each being connected to a respective one of said first and second switch contacts to selectively switch the current through one or the other of the parallel connected variable resistance means to drive the motor.

6. An apparatus as in claim 1 in which said first and second electrical control means each comprise variable resistance means which are selectively adjustable to control the current flow to the motor and thereby the speed of the motor and the respective print and flood strokes.

7. An apparatus as in claim 6 wherein said variable resistance means comprise potentiometers.

8. Apparatus as in claim 7 further including manually adjustable knobs connected to each of said potentiometers to vary the current flow therethrough.

9. Apparatus as in claim 1 wherein said limit switch means comprises two separately actuated cam operated switches each actuating a movable contact, and a double pole single throw switch for selectively connecting to said first and second electrical control means.

* * * * *